US008384491B2

(12) United States Patent
Hsieh et al.

(10) Patent No.: US 8,384,491 B2
(45) Date of Patent: Feb. 26, 2013

(54) SIGNAL TRANSMISSION APPARATUS

(75) Inventors: Po-Chuan Hsieh, Taipei Hsien (TW); Hsiao-Yun Su, Taipei Hsien (TW); Yu-Chang Pai, Taipei Hsien (TW); Shou-Kuo Hsu, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 656 days.

(21) Appl. No.: 12/620,559

(22) Filed: Nov. 17, 2009

(65) Prior Publication Data

US 2010/0328181 A1 Dec. 30, 2010

(30) Foreign Application Priority Data

Jun. 25, 2009 (CN) ..... 2009 1 0303694

(51) Int. Cl.
*H01P 3/08* (2006.01)

(52) U.S. Cl. ..... 333/4; 333/33

(58) Field of Classification Search ..... 333/4, 5, 333/26, 33, 156, 161, 204, 205, 238, 246
See application file for complete search history.

(56) References Cited

U.S. PATENT DOCUMENTS 6,822,534 B2 * 11/2004 Uriu et al. ..... 333/185
2008/0258838 A1 * 10/2008 Oshima ..... 333/25

* cited by examiner

*Primary Examiner* — Benny Lee
*Assistant Examiner* — Gerald Stevens
(74) *Attorney, Agent, or Firm* — Altis Law Group, Inc.

(57) ABSTRACT

A signal transmission apparatus includes two circuit layers. First and second ground sheets are arranged in the two circuit layers respectively. A third ground sheet is arranged between the two circuit layers. A differential pair includes a transmission line arranged between the first and third ground sheets and a transmission line arranged between the second and third ground sheets. The first to third ground sheets have same electric potential. Projections of the first and second ground sheets on the third ground sheet superpose a border of the third ground sheet. The third ground sheet is formed by extending the border along a signal transmission direction. A vertical distance between the first and second transmission lines is twice as each of a vertical distance from the first ground sheet to the first transmission line and a vertical distance from the second ground sheet to the second transmission line.

9 Claims, 4 Drawing Sheets

SIGNAL TRANSMISSION APPARATUS

BACKGROUND

1. Technical Field

The present disclosure relates to signal transmission systems, and particularly to a signal transmission apparatus used in a signal receiver or a signal transceiver of a wireless transmission system.

2. Description of Related Art

Wireless transmission is widely used in communications and networks. Consequently, electronic devices can be moved freely without limitations of wires when transmitting signals. In a wireless transmission system, a signal for transmission is modulated by a high frequency carrier in a signal transceiver, to generate a radio frequency signal. The radio frequency signal is transmitted to a signal receiver via air, and is demodulated into the signal for transmission in the signal receiver. Bad signal quality may be induced if signal transmission paths of the radio frequency signal in the signal transceiver and the signal receiver are improperly designed.

DETAILED DESCRIPTION

Figure 1:
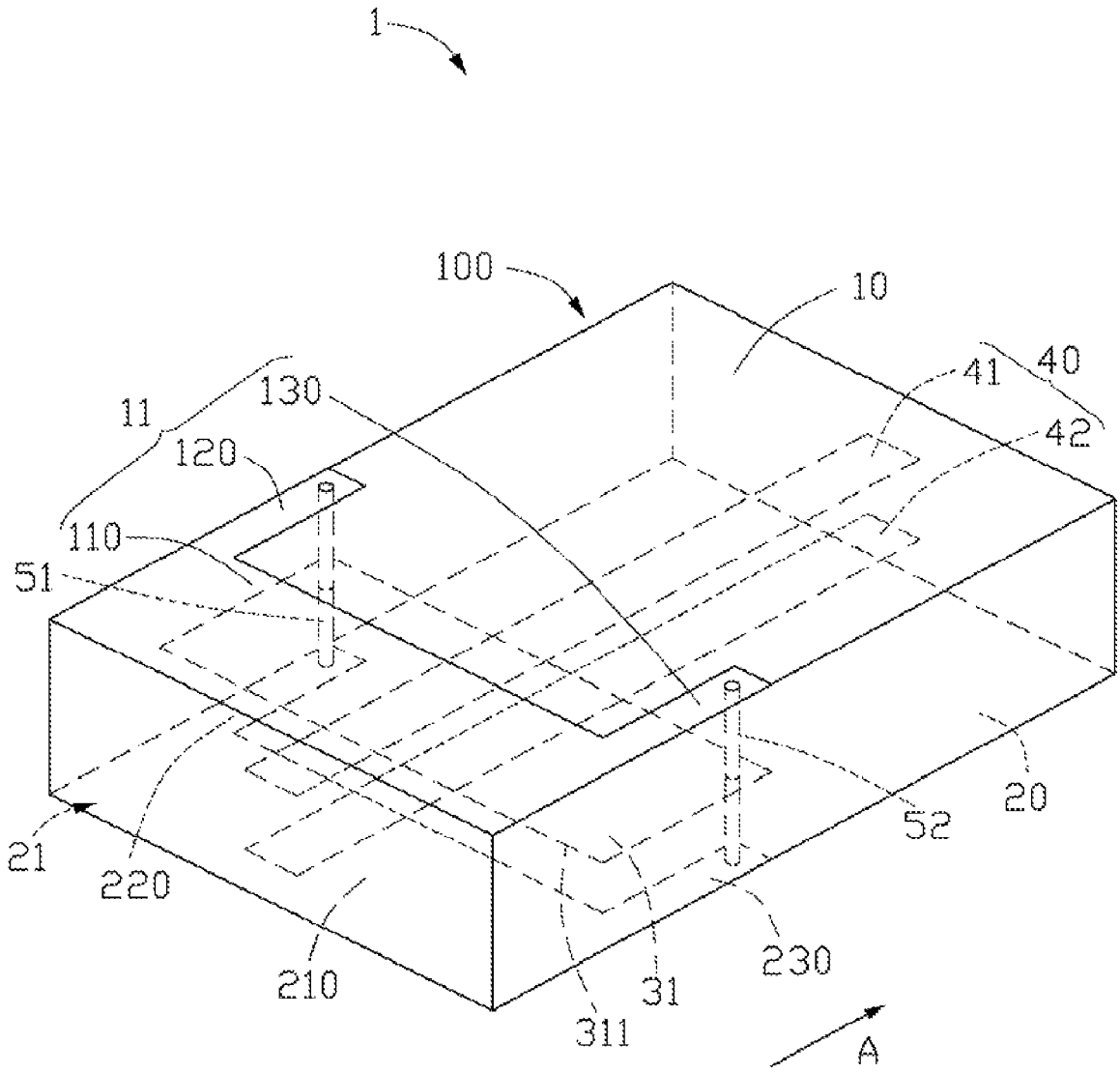
FIG. 1 is an isometric view of a signal transmission apparatus according to an embodiment of the present disclosure.
Figure 2:
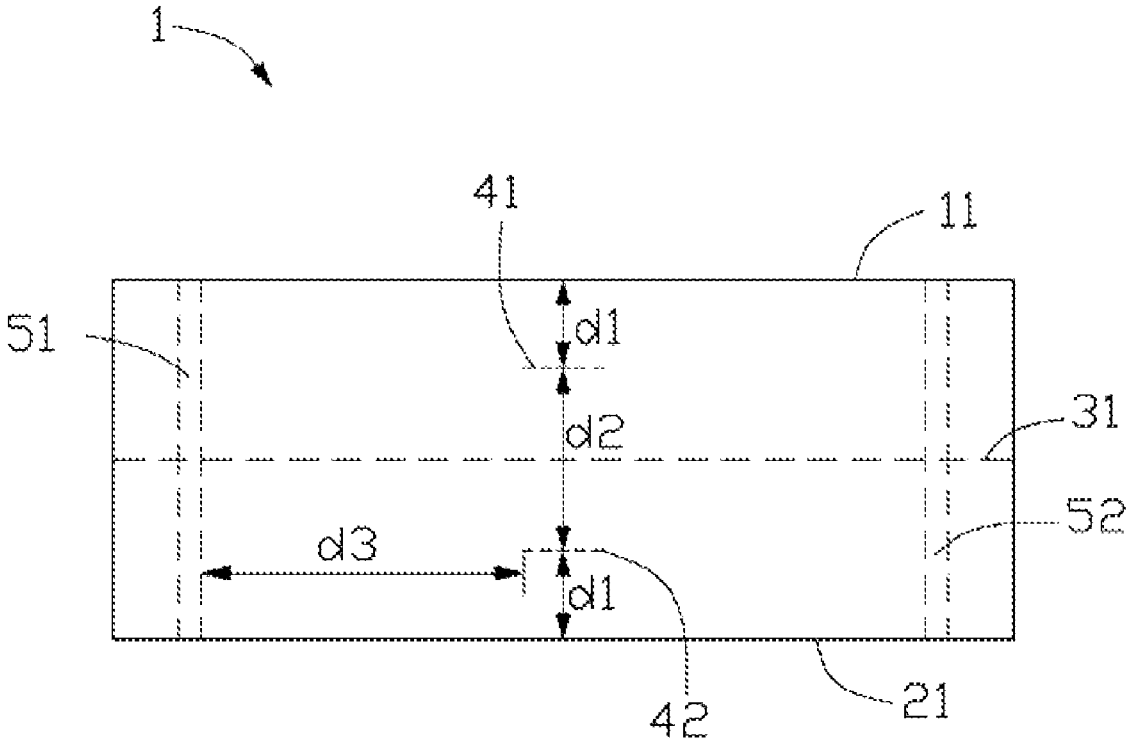
FIG. 2 is a left elevational view of the signal transmission apparatus of FIG. 1.

Referring to FIGS. 1 and 2, an embodiment of a signal transmission apparatus 1 is used in a printed circuit board (PCB) 100. The apparatus 1 includes three ground sheets 11, 21, and 31, a differential pair 40, and two through holes 51 and 52. The ground sheets 11, 21, and 31 are parallel to one another. The ground sheet 11 is arranged in a first circuit layer 10 of the PCB 100. The ground sheet 21 is arranged in a second circuit layer 20 of the PCB 100. There is glass fiber epoxy resin (FR-4) material arranged between the first and second circuit layers 10 and 20. The ground sheet 31 is arranged in the FR-4 material between the first and second circuit layers 10 and 20. The ground sheets 11, 21, and 31 are made of conductive material, such as copper. Each of the ground sheets 11 and 21 is a "U" shaped structure.

The ground sheet 11 includes a rectangular area 110, and two areas 120 and 130 extended from two opposite ends of a side of the rectangular area 110, respectively. The ground sheet 21 includes a rectangular area 210, and two areas 220 and 230 extended from two opposite ends of a side of the rectangular area 220, respectively. An orthogonal projection of the ground sheet 11 on the second circuit layer 20 superposes the ground sheet 21.

The ground sheet 31 is rectangular in shape. Orthogonal projections of the rectangular areas 110 and 210 on the ground sheet 31 superpose a border 311 of the ground sheet 31. The ground sheet 31 is formed by extending the border 311 along a signal transmission direction indicated by the arrow A of FIG. 1.

The through hole 51 vertically passes through the extended area 120, the ground sheet 31, and the extended area 220. The through hole 52 vertically passes through the extended area 130, the ground sheet 31, and the extended area 230. The ground sheets 11, 21, and 31 are conductively connected by the through holes 51 and 52. Therefore, the ground sheets 11, 21, and 31 have same electric potentials.

The differential pair 40 transmits differential signals along the signal transmission direction A, and are parallel to the ground sheets 11, 21, and 31. The differential pair 40 includes two transmission lines 41 and 42. The transmission line 41 is arranged between the first circuit layer 10 and a surface where the ground sheet 31 is arranged in. The transmission line 42 is arranged between the second circuit layer 20 and the surface where the ground sheet 31 is arranged in. As illustrated in FIG. 2, a vertical distance between the transmission line 41 and the ground sheet 11 is denoted by d1. A vertical distance between the transmission line 42 and the ground sheet 21 is equal to the vertical distance d1. A vertical distance between the transmission lines 41 and 42 is denoted by d2. In this embodiment, the vertical distance d2 is twice as much as the vertical distance d1. A horizontal distance between each of the through holes 51, 52 and the differential pair 40 is denoted by d3.

The signal transmitted by the differential pair 40 is firstly affected by the rectangular areas 110 and 210 of the ground sheets 11 and 21. After that, the signal is affected by the ground sheet 31. By these arrangements, the ground sheet 11, 21, and 31 have the same electric potential, and orthogonal projections of the rectangular areas 110 and 210 on the ground sheet 31 only have one common border with the ground sheet 31, a continuous characteristic impedance of the differential pair 40 is obtained. Therefore, common mode noise is reduced during signal transmission, and signal transmission quality of the differential pair 40 is improved.

Figure 3:
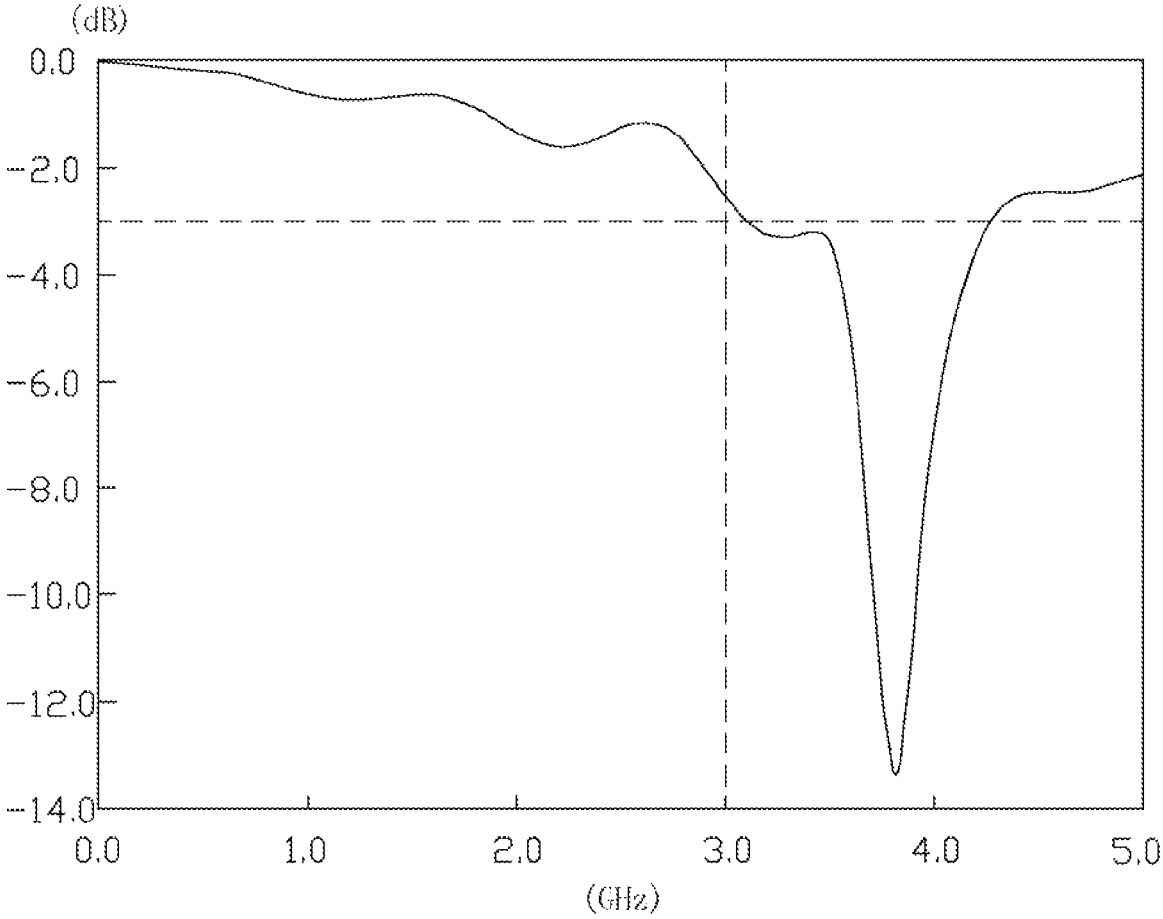
FIG. 3 is a simulation graph of insertion loss of a difference-mode input for the signal transmission apparatus of FIG. 1.
Figure 4:
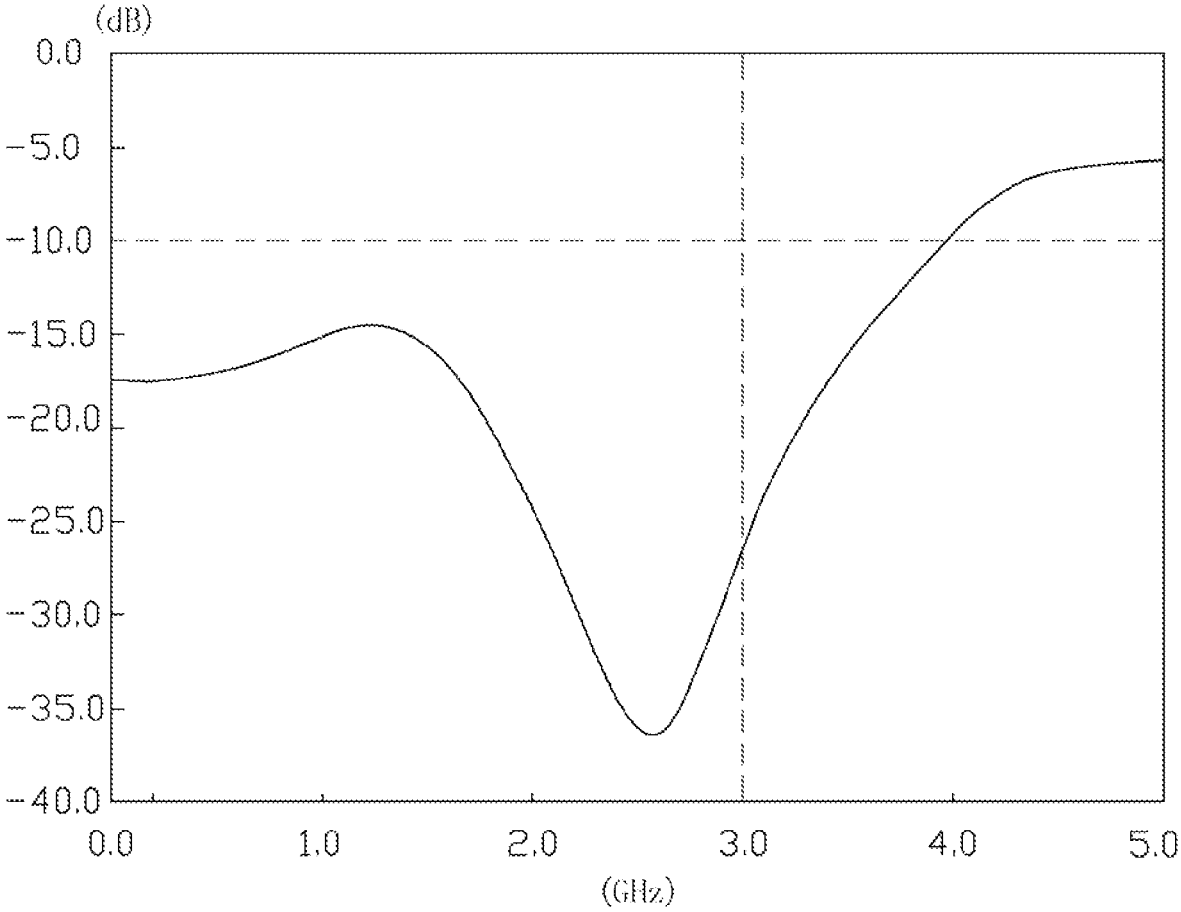
FIG. 4 is a simulation graph of insertion loss of a common-mode input for the signal transmission apparatus of FIG. 1.

FIG. 3 is a graph showing an insertion loss of a difference-mode input for the differential pair 40. FIG. 4 is a graph showing an insertion loss of a common-mode input for the differential pair 40. The curves of FIGS. 3 and 4 represent simulation results of the differential pair 40. It can be determined from FIG. 3 that a required performance of difference mode signal transmission is achieved in a frequency bandwidth from 0 gigahertzs (GHZ) to 3 GHZ since the corresponding gain values are close to 0 dB. It can be determined from FIG. 4 that common noise can be suppressed efficiently in a frequency bandwidth from 0 GHZ to 3 GHZ since the corresponding gain values are less than −15 dB.

The differential pair 40 transmits signals in cooperation with the ground sheets 11, 21 and 31. The signal transmission apparatus 1 can be used in wireless transmission devices, such as wireless network card and access point. The signal transmission apparatus 1 can also be used in wired transmission devices.

The foregoing description of the exemplary embodiments of the disclosure has been presented only for the purposes of illustration and description and is not intended to be exhaustive or to limit the disclosure to the precise forms disclosed. Many modifications and variations are possible in light of the above everything. The embodiments were chosen and described in order to explain the principles of the disclosure and their practical application so as to enable others of ordinary skill in the art to utilize the disclosure and various embodiments and with various modifications as are suited to the particular use contemplated. Alternative embodiments will become apparent to those of ordinary skills in the art to which the present disclosure pertains without departing from its spirit and scope. Accordingly, the scope of the present disclosure is defined by the appended claims rather than the foregoing description and the exemplary embodiments described therein.

What is claimed is:

1. A signal transmission apparatus comprising:

a first ground sheet arranged in a first circuit layer of a printed circuit board (PCB);

a second ground sheet arranged in a second circuit layer of the PCB;

a third ground sheet arranged between the first and second circuit layers; and a differential pair comprising a first transmission line and a second transmission line parallel to the first transmission line, wherein the first transmission line is arranged between the first and third ground sheets, the second transmission line is arranged between the second and third ground sheets; wherein the first, second, and third ground sheets have the same electric potentials, and are parallel to a signal transmission direction of the differential pair, orthogonal projections of the first and second ground sheets superpose a border of the third ground sheet, the third ground sheet is formed by extending the border along the signal transmission direction, and a vertical distance between the first and second transmission lines is twice as much as each of a vertical distance from the first ground sheet to the first transmission line and a vertical distance from the second ground sheet to the second transmission line.

2. The signal transmission apparatus of claim 1, wherein the orthogonal projection of the first ground sheet superposes the orthogonal projection of the second ground sheet.

3. The signal transmission apparatus of claim 1, wherein each of the first and second ground sheets comprises a rectangular area, a first extended area, and a second extended area, the first and second extended areas of the first and second ground sheets are extended from two opposite ends of a side of the corresponding rectangular area.

4. The signal transmission apparatus of claim 1, wherein the first, second, and third ground sheets are electrically connected by first and second through holes, the first through hole passes through a first extended area of the first ground sheet, the third ground sheet, and a first extended area of the second ground sheet vertically, the second through hole passes through a second extended area of the first ground sheet, the third ground sheet, and a second extended area of the second ground sheet vertically.

5. The signal transmission apparatus of claim 4, wherein a horizontal distance between the first through hole and the differential pair is equal to a horizontal distance between the second through hole and the differential pair.

6. The signal transmission apparatus of claim 1, wherein there is glass fiber epoxy resin (FR-4) material arranged between the first and second circuit layers, the third ground sheet is arranged in the FR-4 material.

7. A signal transmission apparatus comprising:

a first circuit layer, a first ground sheet arranged in the first circuit layer and comprising a first rectangular area;

a second circuit layer, a second ground sheet arranged in the second circuit layer and comprising a second rectangular area;

a third ground sheet arranged between the first and second circuit layers; and a differential pair comprising a first transmission line arranged between the first circuit layer and the third ground sheet, and a second transmission line arranged between the second circuit layer and the third ground sheet; wherein the first to third ground sheets are parallel to a signal transmission direction of the differential pair, and have the same electric potentials, orthogonal projections of the first and second rectangular areas of the first and second ground sheets superpose a border of the third ground sheet, the third ground sheet is formed by extending the border along the signal transmission direction, a vertical distance between the first and second transmission lines is twice as much as each of a vertical distance from the first ground sheet to the first transmission line and a vertical distance from the second ground sheet to the second transmission line.

8. The signal transmission apparatus of claim 7, wherein the third ground sheet is rectangular in shape.

9. A signal transmission apparatus in a printed circuit board (PCB), the signal transmission apparatus comprising:

a first ground sheet arranged in an upper circuit layer of the PCB;

a second ground sheet arranged in a lower circuit layer of the PCB;

a third ground sheet arranged in a middle circuit layer of the PCB; and a differential pair comprising a first transmission line and a second transmission line parallel to the first transmission line, wherein the first transmission line is arranged between the first and third ground sheets, the second transmission line is arranged between the second and third ground sheets; wherein the first and second ground sheets superpose each other, each of the first and second ground sheets has a border that overlaps a border of the third ground sheet and extends an extended area over the third ground sheet, thereby a through hole can only extend through the extended areas of the first and second ground sheets and the third ground sheet to achieve the same electric potential for the first, second, and third ground sheets, a vertical distance between the first and second transmission lines is twice as much as each of a vertical distance from the first ground sheet to the first transmission line and a vertical distance from the second ground sheet to the second transmission line.

* * * * *